US007114919B2

(12) United States Patent
Scholz et al.

(10) Patent No.: US 7,114,919 B2
(45) Date of Patent: Oct. 3, 2006

(54) GUIDING GRID OF VARIABLE GEOMETRY

(75) Inventors: Georg Scholz, Wosilsstein (DE); Joerg Jennes, Bockenhelm (DE)

(73) Assignee: Borgwarner, Inc., Auburn Hills, MI (US)

( * ) Notice: Subject to any disclaimer, the term of this patent is extended or adjusted under 35 U.S.C. 154(b) by 0 days.

(21) Appl. No.: 10/706,180

(22) Filed: Nov. 12, 2003

(65) Prior Publication Data

US 2004/0096317 A1 May 20, 2004

(30) Foreign Application Priority Data

Nov. 11, 2002 (EP) ..... 02025181

(51) Int. Cl.
*F01D 17/12* (2006.01)

(52) U.S. Cl. ..... 415/164

(58) Field of Classification Search ..... 415/150, 415/159, 160, 162–166
See application file for complete search history.

(56) References Cited

U.S. PATENT DOCUMENTS

| | | | | |
|---|---|---|---|---|
| 3,146,626 A | * | 9/1964 | Hanselmann | 415/163 |
| 4,179,247 A | | 12/1979 | Osborn | |
| 5,028,208 A | * | 7/1991 | Mitsubori et al. | 415/164 |
| 5,123,246 A | | 6/1992 | Younessi et al. | |
| 5,146,752 A | | 9/1992 | Bruestle | |
| 5,444,980 A | | 8/1995 | Dellora et al. | |
| 5,549,449 A | | 8/1996 | McInerney | |
| 6,050,775 A | | 4/2000 | Erdmann | |
| 6,148,793 A | | 11/2000 | Faletti et al. | |
| 6,623,240 B1 | * | 9/2003 | Ertl et al. | 415/163 |
| 2002/0098081 A1 | | 7/2002 | Ertl | |

FOREIGN PATENT DOCUMENTS

| | | | | |
|---|---|---|---|---|
| FR | 1442174 A | * | 5/1966 | 415/164 |
| GB | 701 557 A | | 12/1953 | |
| JP | 2000 199433 A | | 7/2000 | |

* cited by examiner

*Primary Examiner*—Christopher Verdier
(74) *Attorney, Agent, or Firm*—Akerman Senterfitt; Stephan A. Pendorf; Greg Dziegielewski

(57) ABSTRACT

A guiding grid of variable geometry for turbines comprises a turbine housing and a plurality of guiding vanes in the housing in angular distances around a central axis. Each vane is pivotal about an associated pivoting axis to assume different angles in relation to the central axis and, thus, to form a nozzle of variable cross-section between each pair of adjacent vanes. A generally annular nozzle ring supports the adjustment shafts of the guiding vanes. A unison ring is displaceable around the central axis relative to the nozzle ring. This unison ring is operatively connected to the vanes via a transmission mechanism in order to pivot them when being displaced to adjust their respective angular position in relation to the central axis. The transmission mechanism comprises a first transmission element with an opening and a second transmission element slidably engaging this opening. This second transmission element is formed as a lever pivotally articulated on one of the rings and being dragged by this ring during relative movement between the unison ring and the nozzle ring, while immerging into the opening of the first transmission element in an approximately radial direction.

6 Claims, 6 Drawing Sheets

GUIDING GRID OF VARIABLE GEOMETRY

FIELD OF THE INVENTION

The present invention relates to a guiding grid of variable geometry for a turbine, particularly for a turbocharger. More particularly, the invention relates to a guiding grid of the type having a plurality of guiding vanes arranged in angular distances around a central axis wherein each vane is pivotal about an associated pivoting axis to assume different angles in relation to the central axis. For pivoting the vanes, a unison ring is displaceable around the central axis relative to the nozzle ring as well as a transmission mechanism for transmitting the respective displacement of the unison ring to the adjustment shafts. This transmission mechanism comprises a first transmission element having an opening in which a second transmission element is slidably guided.

BACKGROUND OF THE INVENTION

Various mechanisms for adjusting the positions of the guiding vanes of a guiding grid of variable geometry have become known, such as in U.S. Pat. Nos. 4,179,247 or 5,146,752. Just the latter illustrates how difficult and tiresome it is to mount the individual parts of the guiding grid in a housing, because various parts have to be fitted into each other and have to be mounted and fixed to one another, particularly when assembling a turbocharger or at least one turbine unit.

From U.S. Pat. No. 5,028,208, a guiding grid has become known in which levers are situated on the adjustment shafts of the guiding vanes, the free end of these levers being provided with an opening between two fork arms. In this opening, a sliding block or pin slides and has its longitudinal axis about parallel to the central axis, while being moved by the unison ring (sliding block gear). The disadvantage of this gear or mechanism is that just when the force of the turbine driving fluid or exhaust gas exerts the highest turning torque onto the guiding vanes, the turning torque exerted by the unison ring is relatively small. This is not so great a problem with combustion motors of small power; however, it is a considerable problem (also in view of wear) particularly with combustion motors of an elevated power.

This becomes then a problem too with respect to automatic adjustment, particularly when controlling the vanes during a braking operation. In this respect, reference should also be made to U.S. Pat. Nos. 5,123,246; 5,444,980 and 6,148,793 which have all an electronic control.

SUMMARY OF THE INVENTION

Therefore, it is an object of the present invention to provide a transmission or connection mechanism which works more reliably particularly because the adjustment moment for adjusting the angular position of the guiding vanes, in the course of their displacement, corresponds at least approximately to the counter-moment exerted by the fluid.

According to the invention these objects are achieved in a surprisingly uncomplicated manner by forming the second transmission element as a lever which is pivotally articulated on one of the rings and is dragged by this ring during relative movement between unison ring and nozzle ring, while irnmerging into said opening of the first transmission element in an approximately radial direction.

According to the new invention the known sliding block gear is replaced according to the invention by a mechanism which represents about a combination of a pitman mechanism (because it carries out a pivotal and a sliding motion) and a crank mechanism or a slider crank mechanism (because the immerging motion of the pitman lever into the opening is similar to the movement of a plunger of a steam locomotive) and could be called, if desired, a "dragged lever mechanism". As will be shown below, an almost perfect adaptation of the adjustment moment to the moments acting onto the guiding vanes is achieved.

In principle, the pitman lever could be fixed to the respective adjustment shaft of a guiding vane, and could immerge into the opening of a first transmission element supported by the unison ring. Tests, however, have shown that it is more favorable if the second transmission element is pivotal directly on the associated ring, while it immerges approximately in a radial direction into the opening of the first transmission element, which, as preferred, is formed on the respective adjustment shaft.

The simplest realization of the pair, consisting of the pitman lever and the opening, could comprise a round rod as the lever which immerges into a cylindrical bore of the first transmission element. However, this requires a very precise guidance over a relatively short guiding path. Therefore, it is preferred, if the pivotal second transmission element (dragged lever) has a generally cornered cross-section, if desired having rounded corners, particularly possessing a generally four-cornered cross-section, e.g. a square cross-section. For practice has shown that in this way guidance problems are avoided, and an additional axial degree of freedom of the pitman lever or dragged lever is given.

One has, of course, to contemplate that all these cooperating parts have to be mounted and, if necessary, have to be dismantled in an easy fashion. Therefore, it is preferred, if the opening of the first transmission element is formed as a groove which is, in particular turned away from the guiding vanes so that one is able to insert the lever simply in axial direction into the opening or groove. In this way, it is, above all, easier to insert all levers in their respective and assigned openings.

BRIEF DESCRIPTION OF THE DRAWINGS

Further details of the invention will become apparent from the following description of embodiments schematically shown in the drawings in which.

DETAILED DESCRIPTION OF THE DRAWINGS

Figure 1:
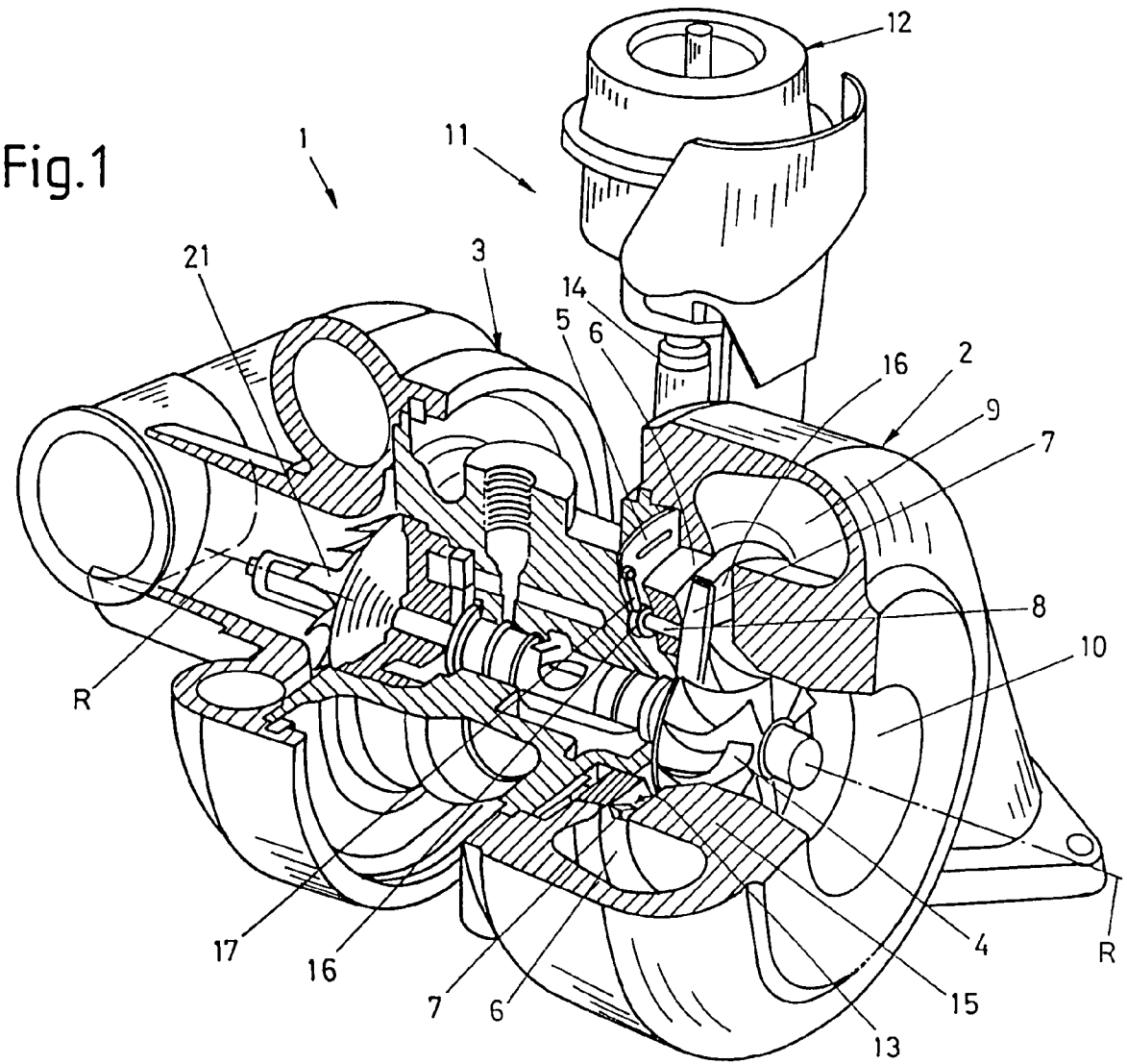
FIG. 1 shows a perspective view of a turbocharger, partially in cross-section, where the present invention is applied.

According to FIG. 1, a turbocharger 1 comprises in a conventional way a turbine housing part 2 and a compressor housing part 3 connected to the turbine housing part 2, both being arranged along an axis of rotation or central axis R. The turbine housing part 2 is shown partially in cross-section so that a nozzle ring 6 for supporting the pivoting or adjustment shafts 8 of guiding vanes 7 may be seen, the adjusting shafts 8 penetrating the nozzle ring 6 and being distributed over the circumference of the nozzle ring 6. The guiding vanes 7 (or vanes 7) are arranged around the axis of rotation R and form a radial outer guiding grid. Thus, each pair of adjacent vanes form a nozzle between them whose cross-section varies in accordance with the angular position of the vanes 7, i.e. either more radial (as represented in FIG. 1) or more tangential, so that this cross-section becomes larger or smaller or the vanes even close the space between them, so that a turbine rotor 4, situated on the axis of rotation R, receives more or less exhaust gas from a combustion motor (not shown) which is entered into the turbine housing part 2 through a supply channel 9 and is admitted to the turbine rotor 4 in a controlled amount by the guiding grid of the vanes 7. The exhaust gas, after having driven the turbine rotor 4 to drive a compressor rotor 21 on the same shaft, is discharged via a central discharge pipe or axial pipe 10.

In order to control the movement or the angular position of the guiding vanes 7, an actuation device 11 is provided. This device might be of any nature, but it is preferred if it presents, in a customary way, a control housing 12 which controls the control motions of a push-rod element 14 whose axial movement is converted by a transmission mechanism having a crank part 16 and a dragged lever 17 on a unison ring 5, located behind the nozzle ring 6 (at left, behind in FIG. 1), into a slight rotational displacement of the former. Details of this transmission mechanism are discussed below.

By this rotational displacement, the positions of the pivoting guiding vanes 7 are adjusted via the adjustment shafts 8 relative to the turbine rotor 4 and the central axis R in such a way that they will be adjusted from one extreme position, where they extend substantially in tangential direction, to another, opposite extreme position, where they extend substantially in radial direction with respect to the central axis R and the turbine rotor 4. Thereby, a larger or smaller amount of an exhaust gas of a combustion motor (or, in the case of other turbines, the fluid), supplied by the supply channel 9 is admitted to the turbine rotor 4, before it leaves the housing through the axial pipe 10 which extends along the axis of rotation R.

There is a relatively narrow space or vane space 13 between the nozzle ring and an annular part 15 of the turbine housing part 2 to allow free movement of the vanes 7. Of course, this vane space 13 should not be substantially larger than the axial width of the vanes 7, because in such a case the fluid energy would suffer leakage losses. On the other hand, the vane space 13 should not be dimensioned too small, because in such a case the vanes 7 could jam.

Figure 2:
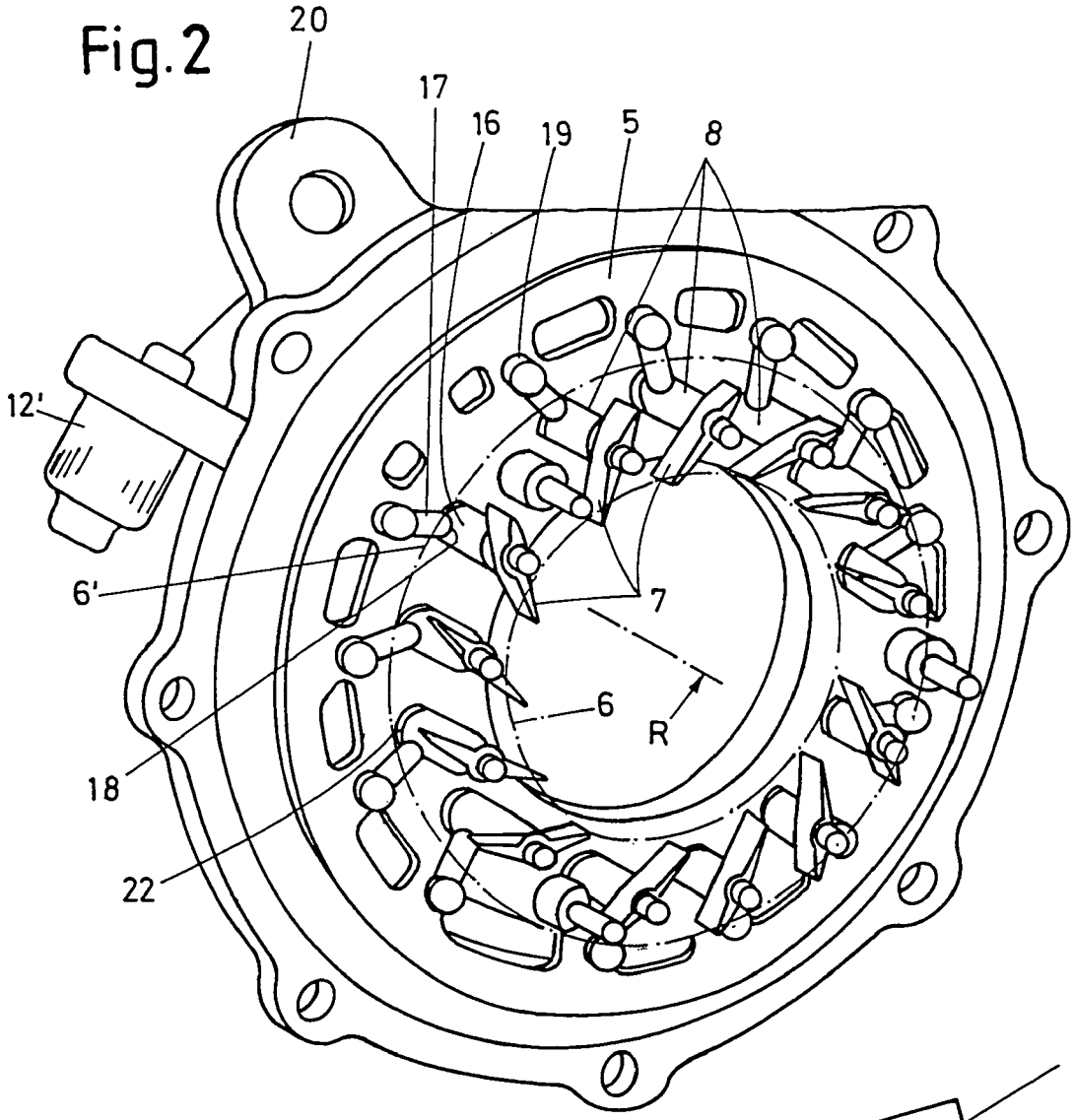
FIG. 2 is a perspective view of a first embodiment of the invention.

In FIG. 2, the nozzle ring is merely indicated in dash-dotted lines for the sake of clarity of the cooperation of the elements so that one can see how the dragged levers 17 immerge into circular bores or bore holes or opening 18, behind the nozzle ring. The dragged levers 17 are articulated at the unison ring 5 by means of swivel pins or points of articulation 19, and extend each about in a radial direction with respect to the central axis R (from which position they may pivot slightly to one or the other side). The unison ring 5, in this embodiment, is driven by an electric motor 12' rather than by a pneumatic control housing, as mentioned above, to be displaced or turned around the central axis R. The electric motor 12' may be a part of a control circuit, such as described in one of the above-mentioned U.S. Pat. Nos. 5,123,246; 5,444,980 and 6,148,793, which are substantially operated using characteristic parameters of a cooperating combustion motor. However, it may be advantageous to take the temperature of a postponed catalyst of a vehicle into account as a further parameter, for example in order to connect a by-pass conduit circumventing the turbocharger to the catalyst (to heat it up when starting), be it via a by-pass channel that connects an exhaust gas manifold of the combustion motor directly to the catalyst, or be it over a so-called waste gate. Controlling the motor 12' while taking into account the catalyst's temperature constitutes an invention of its own, independent from the construction of the transmission mechanism, because in this way, hot exhaust gas may be directly supplied to the catalyst, thus avoiding heat energy losses in the turbocharger. The algorithm or combination of the temperature value, as measured, to the characteristic motor parameters may be a fuzzy algorithm or a neuronal one, performing thus in any case a weighting function.

Figure 5:
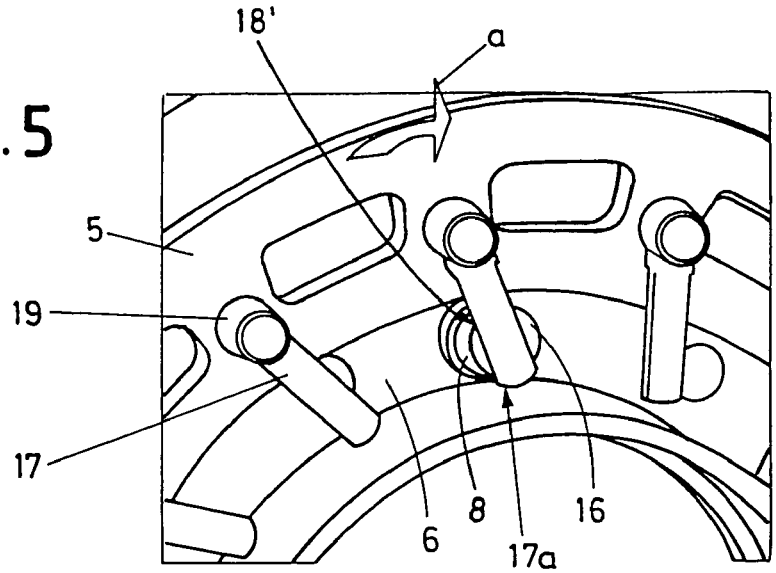
FIGS. 5 to 7 illustrate enlarged views of the invention.
Figure 6:
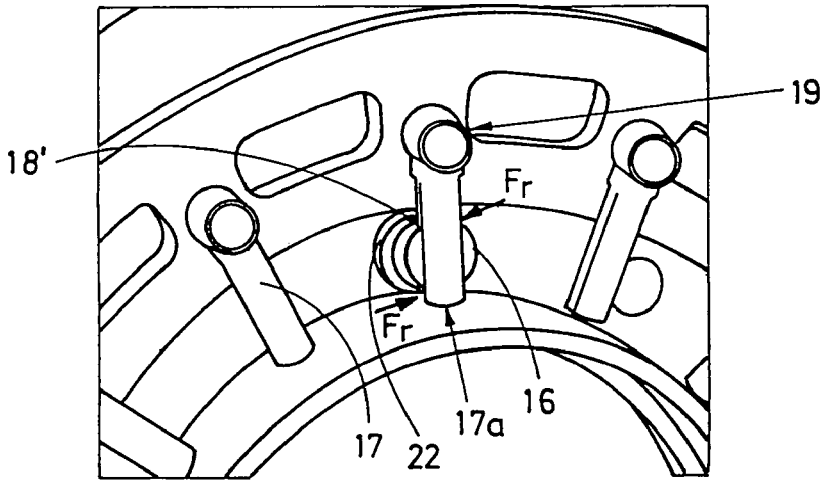
Figure 7:
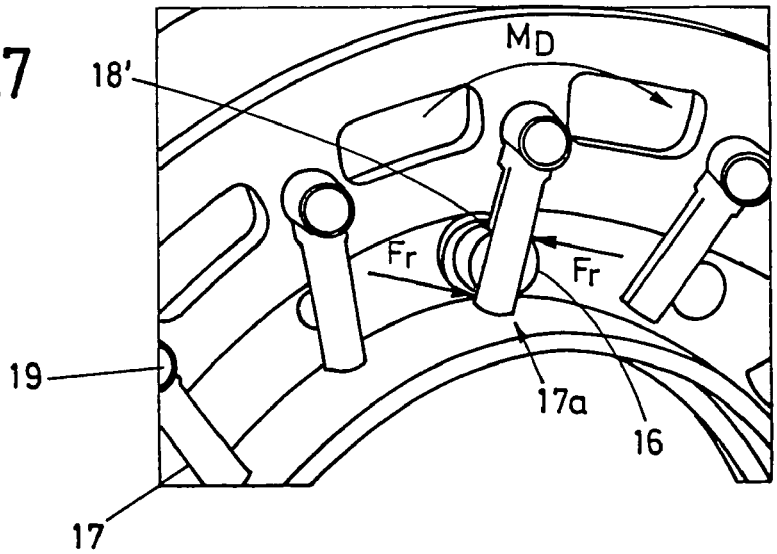

As best seen in FIGS. 5 to 7, the swivel pins 19, when displacing the unison ring, shift by a predetermined angle with respect to the stationary adjustment shafts 8 (because they are on the stationary nozzle ring) which support each of the associated guiding vanes 7. Therefore, the adjustment shafts 8 are also pivoted within the nozzle ring 6 and, while doing so, have a special characteristic of movement and moment. One consequence is that the maximum surface pressure of the dragged lever 17 to the inner surface of the opening 18, and vice-versa, is relatively small so that wear is also small and reliability in operation is high. Because surface pressure is always exerted at least approximately perpendicularly to the respective surface, no one-sided loads will occur.

The unison ring 5 is a relatively narrow ring whose inner limits, according to FIG. 2, is about there, where the dash-dotted profile 6' of the nozzle ring 6 can be seen. Therefore, the unison ring 5 may be supported and centered by the end surfaces of adjustment shafts 8. However, since the adjustment shafts turn faster than the unison ring 5 due to the transmission ratio between the unison ring 5 and the adjustment shafts 8, it is advantageous to attach a freely rotating supporting roller or cylinder roller 22 at the ends of at least part of the adjustment shafts 8, as is best seen in FIG. 3.

Figure 3:
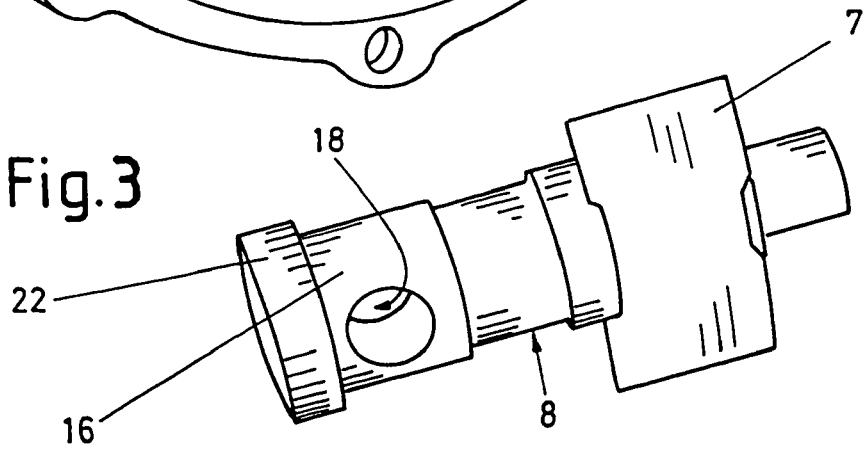
FIG. 3 illustrates an individual adjustment shaft together with the adjustment vane.

Since the dragged lever 17 is supported by the unison ring 5, a simple and easily producible form of the units of guiding vanes 7 and adjustment shafts will result, as is illustrated in FIG. 3. Of course an inversed arrangement is conceivable in which a crank part, corresponding to crank part 16, is arranged instead of the swivel pins 19, whereas the dragged levers 17 would project from the adjustment shafts 8. However, this would make production of the unit, as shown in FIG. 3 (which would then comprise a laterally projecting lever in addition), more complicated.

While the openings 18 penetrated by the dragged levers 17, according to the embodiment of FIGS. 2 and 3, are formed by circular borings, an embodiment will be illustrated now with reference to the following figures which uses a unilaterally open groove 18' in the crank part 16. This embodiment has functioned well in practice and is, therefore, preferred. In the following figure, parts of the same function have the same reference numerals as in the previous figures, while parts of only a similar function have the same reference numeral, but are primed ("").

Figure 4:
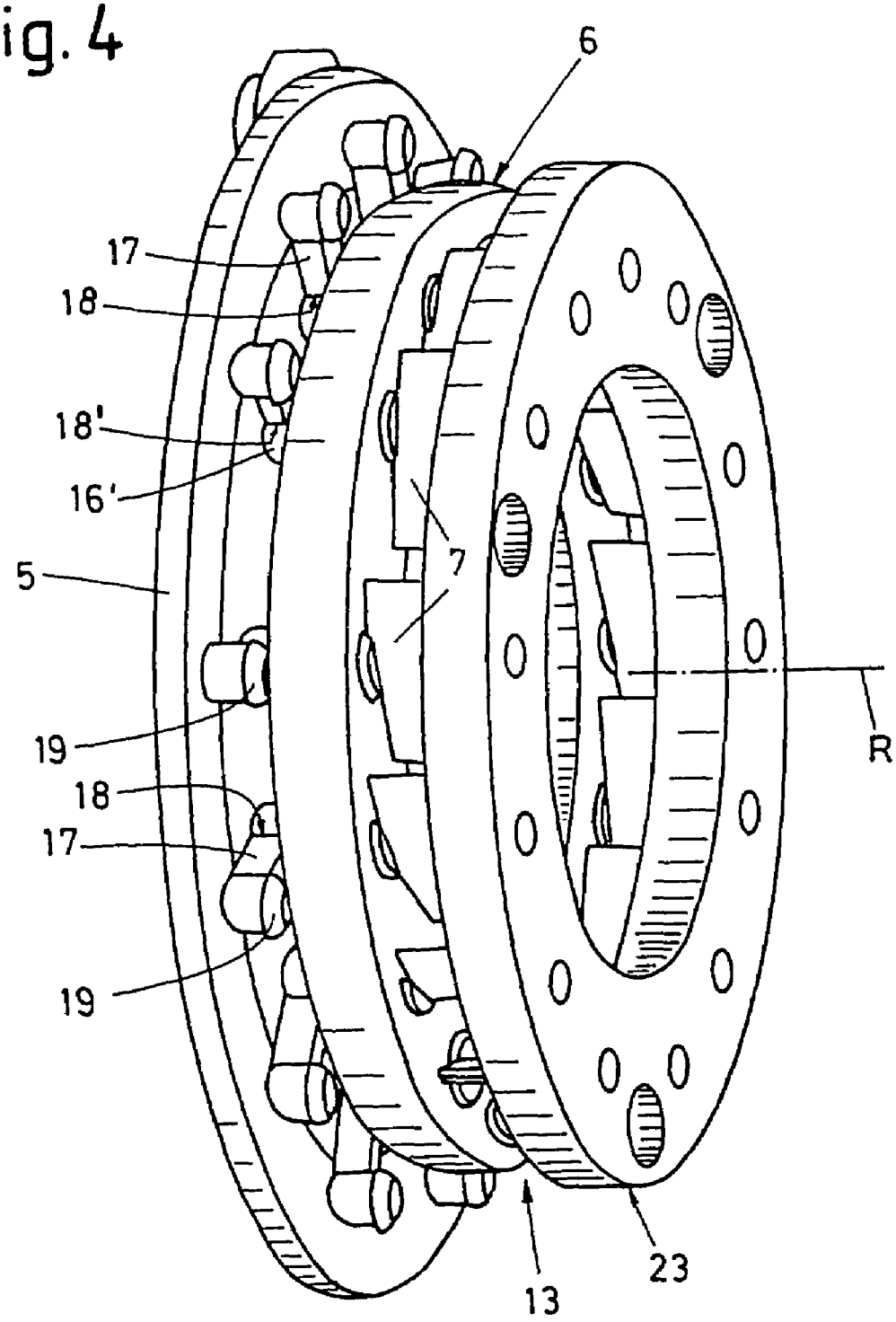
FIG. 4 is a perspective view of a preferred embodiment of the invention.

In FIG. 4 the rings 5 and 6 as well as a mounting ring 23 are shown. Between the mounting ring 23 and the nozzle ring 6 extends a vane space 13 in which the guiding grid formed by the vanes 7 around the central axis R is accommodated. The adjustment shafts 8 (in this figure not visible, see FIG. 3) are supported in the nozzle ring 6 and are, preferably each integrally formed with the respective vane 7, as is illustrated in FIG. 3.

At the left end of the adjustment shafts (as seen in FIG. 4) projecting from the nozzle ring 6 is again a crank part 16' which, however, comprises a groove 18', extending transversely to its pivot axis and being open towards the unison ring 5, which forms the opening that receives the respective dragged lever 17. Particularly in this embodiment, the dragged levers 17 press with their flat surfaces against the inner surfaces of the groove 18', thus being subjected to a small and uniform surface pressure. In order to obtain such flat surfaces, it is advantageous, if the respective dragged lever 17, pivoting about the swivel pins 19, has a generally cornered cross-section, optionally having rounded corners, particularly an about four-cornered cross-section.

Now the function of this mechanism will be explained with reference to FIGS. 5 to 7. In each of these figures a single crank part 16 together with the associated dragged lever 17 is shown in different positions. When the unison ring 5 is displaced in the direction of arrow a (clockwise), a comparison of FIGS. 5 to 7 shows that the dragged levers 17 too will pivot in clockwise direction about their point of articulation 19. This pivoting movement amounts, in the present example, to about 40°, while the angular displacement of the unison ring 5 is much smaller. Thus, depending on the point of view, a movement increasing or decreasing ratio will be obtained.

In the position according to FIG. 5, for example, the lower end surface 17*a* of the dragged lever 17 having about a rectangular cross-section is aligned with the outer surface of the crank part 16. The acting force is small, and the dragged lever 17 covers completely the opening formed as a groove 18'. This groove 18' is averted from the vanes (not shown here), but a construction could also be contemplated where the opening of the groove is facing the vanes. Such constructions would, however, be more complicated and space consuming and are, therefore, not preferred.

When the unison ring 5 displaces in the direction of arrow a by about 20° into a middle position according to FIG. 6, the dragged lever 17 immerges deeper into the groove 18', i.e. the force introduced becomes greater, and the reaction force Fr (i.e. the surface pressure between the inner surface of the groove 18' and the outer surface of the dragged lever 17), due to the closing guiding grid, becomes continuously greater too, in correspondence with the force arrows $F_r$. Here is the deepest point of immersion of the dragged lever 17 into the opening of the crank part 16 formed as a groove 18'. In this position, the dragged lever 17 is oriented about in a radial direction with respect to the central axis R (see also FIG. 2), and the distance of its end surface 17*a* from this central axis R is the smallest. By the way, when looking at the cylinder roller 22 (see also FIG. 3), it may well be seen in FIG. 6 how the unison ring 5 is supported by this cylinder roller (and, of course, also by all other cylinder rollers not visible in this figure). Thus, the unison ring 5, in an advantageous manner, is supported by a kind of anti-friction bearing.

When the unison ring 5 displaces by further 20°, the position according to FIG. 7 is reached. Since the construction of this embodiment is approximately symmetric (which is not necessary under all circumstances, as will be explained below), the end surface 17*a* is again aligned with the outer surface of the crank part 16, i.e. the inner surface of the groove 18' between the two arrows $F_r$ (FIG. 7) will be still fully utilized for transmitting the surface pressure. When turning from the position of FIG. 6 to that of FIG. 7, the maximum pressure difference $M_D$ induces the maximum surface pressure $F_r$ between the inner surface of the groove 18' between the two arrows $F_r$ and the outer surface of the dragged lever 17 having preferably a rectangular cross-section.

The above explanations are, of course, to be applied in an analogous manner to an embodiment having a circular bore hole 18 in accordance with FIGS. 2 and 3; they are, however, also to be applied in substance in the case of an inversed arrangement where the dragged levers 17 are attached to the adjustment shaft 8, which carries the crank part 16, and immerge into an opening of a part, that corresponds to the crank part 16 and is provided instead of the swivel pin 19. However, it becomes clear why it is advantageous to form a cornered cross-section of the dragged lever 17, particularly a four-cornered cross-section (optionally with rounded corners), because then the surface pressure acts in all points perpendicularly onto the respective surface.

From the above-mentioned function it will be apparent that, although the cross-sectional shape of the dragged lever in the preferred case will be a four-cornered one, other cross-sectional shapes are conceivable without altering the basic function. For example, a six-cornered cross-sectional shape would be conceivable (though it is not preferred). Furthermore, one could imagine that the dragged levers 17 have about a T-shape cross-section, the transverse bar of the T lying over the front surface of the crank part 16 as a cover, while a rib, forming the stem of the T, engages the groove 18'. However, this would enlarge the axial dimension of the construction and would involve a shape that is more difficult to manufacture.

Figure 8:
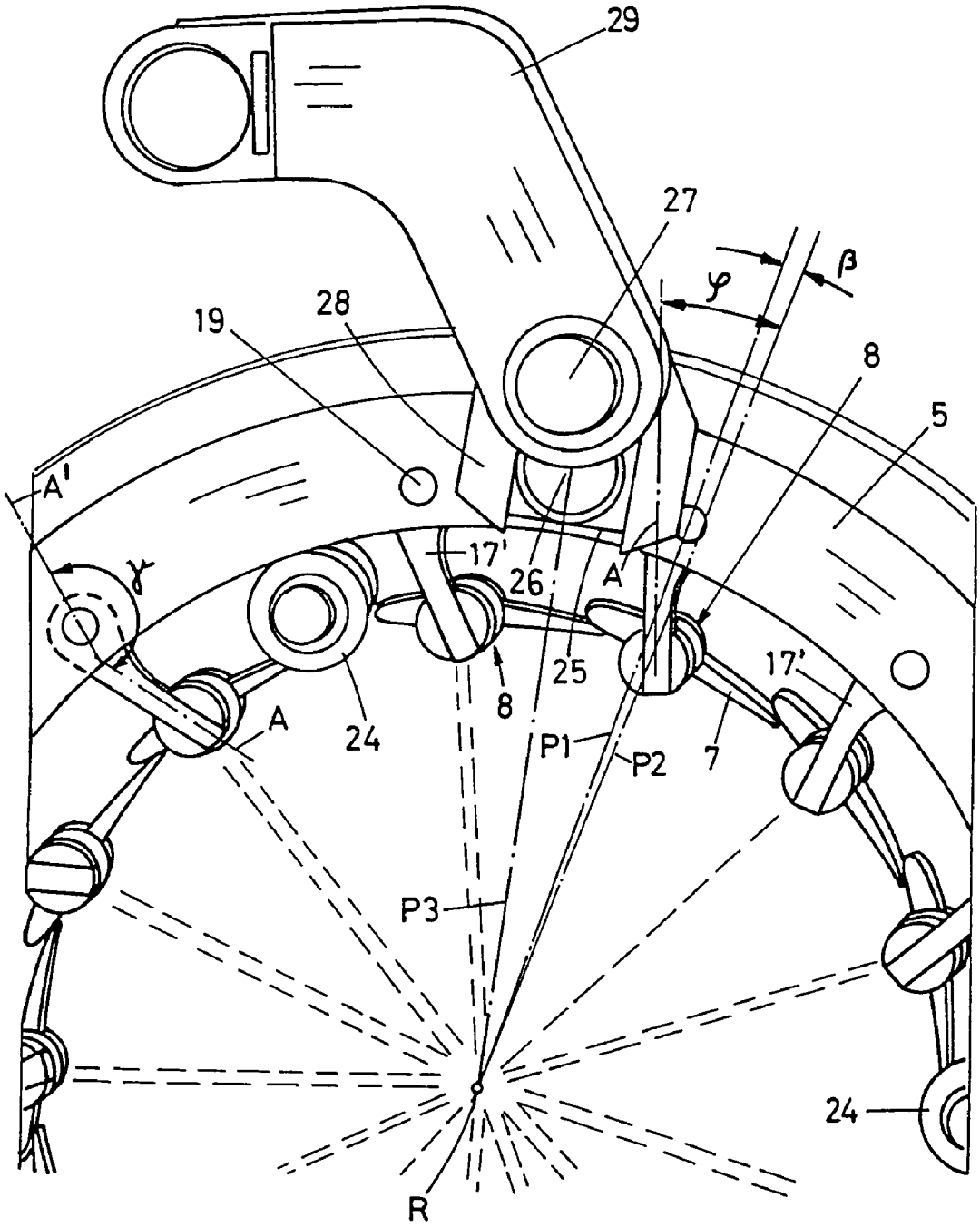
FIG. 8 shows a perspective view of detail of a further embodiment illustrating the guiding grid of guiding vanes, while the nozzle ring is omitted.

The positions of the guiding vanes 7 related to the positions of the dragged levers 17 shown in FIGS. 5 to 7 can best be derived from FIG. 8 which shows a variant comprising offset or cranked dragged levers 17 in a position that corresponds about to that of FIG. 5 (closed position of the vanes 7, while the maximum moment acts on them) . It can be seen that the closed position of the guiding vanes 7 is approximately reached when a fork 28 is at least nearly parallel to a middle plane P3. However, the present invention is not limited to such a construction; for example, the fork 28 could have curved fork arms instead of parallel ones, e.g. if a modification of the characteristic is desired.

In FIG. 8, the unison ring 5 is supported by supporting rollers 24 mounted on the nozzle ring 6 (not shown). In this way, the unison ring 5 is spaced in radial direction from the adjustment shafts 8 so that the length of the dragged levers 17 is longer than in the former embodiments. In an analogous way, in the case of using cylinder rollers 22 for supporting the unison ring 5, only three such rollers may be provided distributed over the circumference. However, if it is desired to use cylinder rollers 22 (FIG. 3) instead of support rollers 24, this could lead to problems when using a groove 18' as an opening. In such a case, the segment parts, which define the groove 18', while being axially prolonged beyond the plain of the respective dragged lever 17, could form the bearing for the cylinder roller 22 (which is not always advantageous), or the cylinder roller 22 is arranged at the front side of the crank part 16 facing the guiding vane 7, instead of that front side of the crank part 16 which is averted from the guiding vanes 7. In such a case, the dragged levers 17 would cooperate with the grooves 18' at that side of the unison ring 5 which looks away from the nozzle ring, while the unison ring 5 would be supported by the cylinder rollers 22 arranged as mentioned above. Thus, it will be appreciated that the use of cylinder rollers 22 rotating about the pivoting axis of the adjustment shafts 8, wherever the rollers 22 are arranged, will result in an advantageous support of the unison ring and, therefore, important in its own right, independent from the use of dragged levers and the associated opening.

The unison ring 5 has a four-cornered sliding block 25 mounted on its periphery which is pivoting about a turning axis 26. This sliding block 25 is engaged by a fork 28 forming a crank that pivots together with a shaft 27. An actuation arm 29 is fixed to the shaft 27 and pivots about the geometrical axis of the shaft 27 being moved either by the push-rod 14 of the control housing 12 (FIG. 1) or by a servo-motor 12' to displace and turning the unison ring 5 about the central axis R by means of the fork 28.

As a difference to the previous embodiments comprising levers 17 whose longitudinal axis A intersects the articulation point 19, slightly offset or cranked or bent off dragged levers 17' are provided in the present embodiment which have proved to be especially favorable. The crank or bending off is advantageously dimensioned in such a way that two geometrical planes P1, P2, which intersect the central axis R, form a predetermined angle β. This angle δ is relatively small and should amount to 12° in maximum, but is preferably smaller so that it amounts to 9° in maximum. In practice, an angle δ of 6° in maximum, e.g. about 2°, has proved to be particularly favorable.

The offset, crank or bending off can also be defined as an angle δ between the plane P2, which intersects the geometrical axis or pivot axis of the adjustment shafts 8 and the central axis R, and the longitudinal axis A of the dragged levers 17'. This angle δ will be large at a small pressure difference in the space 13 (FIG. 1) and decreases with increasing load acting onto the guiding vanes 7 (i.e. FIG. 8 shows the smallest angle δ occurring in this embodiment). For this reason it can be understood why it is preferred to choose the angular position of the respective opening 18 or 18' (which coincides with the direction of the longitudinal axis A) in such a manner that the longitudinal axis A of a dragged lever 17' relative to a radial plain P2 through the central axis R, in the case of the closed position of the guiding vanes 7 (braking operation), assumes an angle δ which deviates from zero (because an orientation of the longitudinal axis A coinciding with this radial plain P2 would result in an unfavorable characteristic of force and moment in this position of the vanes 7). The angle δ should be chosen as a function of the respective design (depending on occurring forces, surface pressure between the inner surface of the opening 18 or 18' and the outer surface of the dragged levers 17 or 17', available final control forces and so on), but should preferably be 25° to 15°, for example approximately 20°. In the present embodiment, the angle δ is between 21° and 22°, thus being in the preferred range of 20°±2°.

Another definition could be provided by the crank angle γ between the axes A, A', A' extending along the lever portion extending from the articulation point 19, while A extends up to the free end of lever 17. This angle γ should be in a range of 170° to 120°, and should preferably amount to about 140°.

Figure 9:
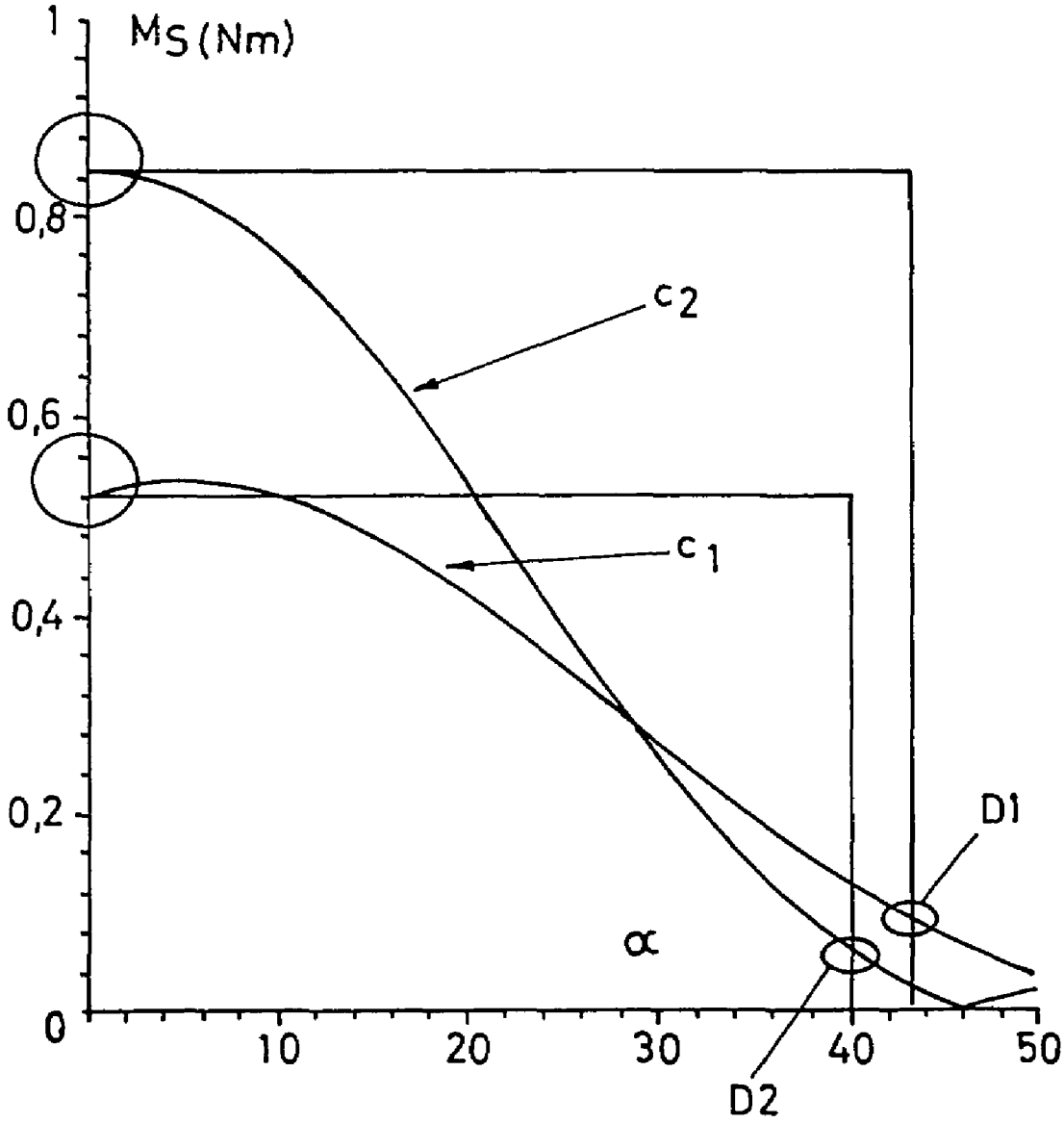
FIG. 9 is a diagram of the characteristic of the resulting guiding vane moment at different charges, showing the curves of a customary turbocharger and a turbocharger according to the present invention.

As seen in FIG. 9, this arrangement induces distinctively more force which means that the final control device (12 or 12') which actuates the lever 29 is considerably relieved. Certainly, a certain loss of force has to be accepted in the braking point (i.e. when the guiding grid with the vanes 7 is closed). However, this loss of force, with an angle β of 6°, corresponds merely to a value of [1−cos(6°)]=0.547% and is, thus, imperceptibly small. With reference to the positions shown in FIGS. 5 to 7, a larger displacement stroke is achieved with less force with such cranked or offset dragged levers 17' in the range between the positions of FIGS. 6 and 7. However, the larger the force, the more the position of the dragged levers 17' approaches that position which corresponds to that of FIG. 5. Measurements have shown that with guiding vanes 7 opened only by 3°, the moment acting on them decreases already by more than 30% (31.25% have been measured). This constitutes the nominal characteristic of the mechanism, and the dragged lever mechanism according to the present invention, particularly according to the embodiment shown in FIG. 8, takes this characteristic particularly into account.

FIG. 9 shows the characteristics of a conventional guiding grid $c_1$ in a turbocharger in comparison with the characteristic $c_2$ of a guiding grid according to the invention. In this diagram, the moment acting on the vanes $M_S$, measured in Nm, is compared with the displacement angle α of the actuation arm 29 about the geometrical axis of the shaft 27 (FIG. 8). It will be seen that the largest moment Ms is attained at 0° (i.e. in relation to a radial orientation −20°), thus just then, when the guiding vanes 7 and the actuation arm 29 are in the position shown in FIG. 8 and have to withstand the maximum moment that acts on them. To the right, however, the moment decreases very much, but up to 40° (i.e. in relation to a radial orientation +20°) does never attain the value of zero (and should not attain this value). It should also be noted that the curve $c_2$ shortly after its point of intersection D2 (end of operative range) decreases to a zero moment and, thus, is about symmetrical within the operative range between a zero load (in point D2) and braking load (upper point at left) which constitutes a further advantage of the guiding grid according to the present invention. For, in comparison, the actuation arm 29 of the known construction having the characteristic $c_1$ had somewhat larger stroke of almost 43°, but intersected the X axis (abscissa) much later than curve $c_2$, so that characteristic $c_2$ had a clear asymmetry. This led to the fact that the maximum moment to be resisted by the known construction was not at an angle α =0, but at about 5 to 6°. In addition, the displacement angle for the curve $c_1$ is smaller than that of curve $c_2$.

Numerous modifications are possible within the scope of the present invention; for example, the guiding grid according to the present invention could be used not only for turbochargers, but also for other turbines or also for secondary air pumps.

REFERENCE LIST

1 Turbocharger
2 Turbine Housing Part
3 Compressor Housing Part
4 Turbine Rotor
5 Unison Ring
6 Nozzle Ring
7 Guiding Vanes
8 Adjustment Shafts
9 Supply Channel
10 Axial Pipe/Central Discharge
11 Actuation Device
12 Control Housing
13 Vane Space
14 Push-rod Element
15 Annular Part
16 Crank Part

17 Dragged Lever
18 Bore Hole
19 Swivel Pins
20 Drive Part
21 Compressor Rotor
22 Rotating Supporting Roller
23 Mounting Ring
24 Supporting Rollers
25 Sliding Block
26 Turning Axis
27 Shaft
28 Fork

What is claimed is:

1. A guiding grid of variable geometry comprising:

a plurality of guiding vanes (7) arranged around a central axis (R), each vane (7) being pivotal about a pivoting axis (8);

a nozzle ring (6) for supporting said vanes (7) and their pivoting axes (8) around said central axis (R);

a unison ring (5) which is pivotable around said central axis (R) relative to said nozzle ring (6); and a transmission mechanism (16–19) by which said unison ring (5) is connected to said vanes (7) for pivoting said vanes (7) about their respective pivoting axes (8), having a first transmission element (16) with an opening (18) in which a second transmission element (17) is slidably guided, wherein said second transmission element (17) is a drag lever (17) which is pivotably guided on an associated ring and in that said drag lever (17) immerges into said opening (18) of the first transmission element (16) in an approximately radial direction;

wherein said drag lever (17) has a longitudinal axis (A, A'), wherein said longitudinal axis (A, A') is bent with respect to its articulation point (19) measured as a bending angle (β), wherein said bending angle (β) is selected so that planes (P1, P2) pass through the central axis (R), through the middle of each respective pivoting axis (8), and through the articulation point (19) of said drag lever (17), and wherein the bending angle (β) is an angle less than about 12°, and that an angle (γ) between the longitudinal axes of bent sections of the drag lever (17) is between about 170° to about 120°.

2. The guiding grid according to claim 1, wherein said bending angle (β) is less than about 9°.

3. The guiding grid according to claim 1, wherein said bending angle (β) is less than about 6°.

4. The guiding grid according to claim 1, wherein said angle between the longitudinal axes of bent sections of the drag lever (17) is about 140°.

5. A guiding grid of variable geometry comprising:

a plurality of guiding vanes (7) arranged around a central axis (R), each vane (7) being pivotal about a pivoting axis (8);

a nozzle ring (6) for supporting said vanes (7) and their pivoting axes (8) around said central axis (R);

a unison ring (5) which is pivotable around said central axis (R) relative to said nozzle ring (6); and a transmission mechanism (16–19) by which said unison ring (5) is connected to said vanes (7) for pivoting said vanes (7) about their respective pivoting axes (8), having a first transmission element (16) with an opening (18) in which a second transmission element (17) is slidably guided, wherein said second transmission element (17) is a drag lever (17) which is pivotably guided on an associated ring and in that said drag lever (17) immerges into said opening (18) of the first transmission element (16) in an approximately radial direction;

wherein on at least some of the pivoting axes (8) a support surface is provided for the unison ring (5).

6. The guiding grid according to claim 5, wherein said support is a support roller (22).

* * * * *